US005534116A

United States Patent [19]

Karvinen et al.

[11] Patent Number: 5,534,116

[45] Date of Patent: Jul. 9, 1996

[54] COMPACT PRESS SECTION WITH CLOSED DRAW OF THE WEB IN A PAPER MACHINE

[75] Inventors: Mikko Karvinen, Vihtavuori; Reima Kerttula, Muurame; Jorma Laapotti, Palokka; Juhani Pajula, Jyvaskyla, all of Finland

[73] Assignee: Valmet Paper Machinery Inc., Helsinki, Finland

[21] Appl. No.: 326,581

[22] Filed: Oct. 20, 1994

Related U.S. Application Data

[60] Division of Ser. No. 25,190, Mar. 2, 1993, Pat. No. 5,393, 383, which is a continuation-in-part of Ser. No. 829,989, Feb. 3, 1992, Pat. No. 5,240,563.

[30] Foreign Application Priority Data

Dec. 19, 1991 [FI] Finland ..... 916026

[51] Int. Cl.[6] ..... D21F 3/04

[52] U.S. Cl. ..... 162/274; 162/275; 162/360.3; 162/359.1; 34/117

[58] Field of Search ..... 162/358.1, 359.1, 162/360.2, 360.3, 294, 275, 193; 34/117, 120

[56] References Cited

U.S. PATENT DOCUMENTS

| | | | |
|---|---|---|---|
| 3,185,617 | 5/1965 | Justus | 12/274 |
| 3,285,806 | 11/1966 | Justus et al. | 162/306 |
| 4,359,827 | 11/1982 | Thomas | 162/359.1 |
| 4,359,828 | 11/1982 | Thomas | 34/114 |
| 4,483,745 | 11/1984 | Wicks et al. | 162/205 |
| 4,526,655 | 7/1985 | Karvinen et al. | 162/360.1 |
| 4,648,942 | 3/1987 | Wanke et al. | 162/286 |
| 4,889,598 | 12/1989 | Niskanen | 162/199 |
| 4,919,762 | 4/1990 | Laapotti et al. | 162/360.1 |
| 4,943,351 | 7/1990 | Wedel | 162/306 |
| 4,976,821 | 11/1990 | Laapotti | 162/360.1 |
| 5,022,163 | 6/1991 | Ilvespaa et al. | 34/23 |
| 5,037,509 | 8/1991 | Wedel | 162/286 |
| 5,049,239 | 9/1991 | Antio | 162/274 |
| 5,178,732 | 1/1993 | Steiner et al. | 162/360.3 |
| 5,240,563 | 8/1993 | Karvinen et al. | 162/274 |
| 5,256,257 | 10/1993 | Schiel | 162/358.3 |
| 5,389,205 | 2/1995 | Pajula et al. | 162/360.2 |

FOREIGN PATENT DOCUMENTS

| | | | |
|---|---|---|---|
| 771159 | 12/1971 | Belgium | 162/360.3 |
| 1068525 | 12/1979 | Canada | 162/360.3 |
| 82500 | 8/1986 | Finland . | |
| 885737 | 6/1990 | Finland . | |
| 2269893 | 11/1990 | Japan . | |
| 697774 | 9/1953 | United Kingdom | 162/360.1 |
| 2039308 | 8/1980 | United Kingdom | 162/360.3 |

*Primary Examiner*—Karen M. Hastings
*Attorney, Agent, or Firm*—Steinberg, Raskin & Davidson

[57] ABSTRACT

The invention relates to a closed press section in a paper machine and comprises a compact combination of press rolls. Several of the rolls define press nips with each other, between which nips the web has a closed draw supported by the face of a fabric. The press section has a center roll in connection with which a press nip or press nips are provided. A closed loop of a transfer band is passed around the center roll. The web is transferred on an outer face of the transfer band after the last press nip in the compact combination of rolls as a closed and constantly supported draw onto a drying wire in a drying section following after the press section. The transfer band loop is made of a transfer band fabric that substantially does not receive water and does not rewet the web. The web-adhesion properties of the outer face of the transfer band fabric are chosen so that, after the last nip, the web follows the transfer band fabric, and so that the web can be transferred as a fully closed draw onto the drying wire. In connection with the loop of the transfer band fabric, means for conditioning of the band and/or safety devices are provided, by whose means an adequate operation of the transfer band fabric is maintained.

17 Claims, 8 Drawing Sheets

COMPACT PRESS SECTION WITH CLOSED DRAW OF THE WEB IN A PAPER MACHINE

This is a division of U.S. patent application Ser. No. 08/025,190, filed Mar. 2, 1993, now U.S. Pat. No. 5,393,383, which is a continuation-in-part of U.S. patent application Ser. No. 07/829,989, filed Feb. 3, 1992, now U.S. Pat. No. 5,240,563.

BACKGROUND OF THE INVENTION

The invention is related to a closed press section in a paper machine, comprising a compact combination of press rolls in which the rolls form press nips with each other. The web has a closed draw between the press nips and is supported by a face of at least one fabric. The press section further comprises a center roll, in connection with which a press nip or press nips are formed. A closed loop of a transfer band is passed around the center roll. The web is transferred on an outer face of the transfer band after the last press nip in the compact combination of rolls, as a closed and constantly supported draw onto a drying wire or an equivalent fabric in the drying section following the press section.

A particular problem in prior art press sections in paper machines is caused by the part in which a web that has passed through the nips in the press section is detached from a smooth-faced roll in the press, in particular from the center roll, and transferred to the drying section of the paper machine. This problem is accentuated with increasing running speeds of paper machines and/or when the paper web is very weak, e.g. when a maximal bulk is desired. In such a case, the pressing is carried out with very low nip loads, and the wet strength of the web remains low. Problem arises in the circumstance that, when the web is being pulled apart from the smooth-faced roll, a high tensile strain is applied to the web. Other problems include the situation where the web is transferred from the press section to the drying section, it must run a short distance as a free and unsupported draw where it is not supported by a roll face or by a fabric. When the running speed of the paper machine is increased, there is a high risk that the paper web will be torn in these problem areas.

In conventional solutions, the web should preferably be detached from the center roll of the press section so that it runs to the drying section in a run which is as straight as possible. Owing to the above, the area of transfer of the web from the press section to the drying section has constituted a significant bottleneck in attempts to increase the running speed of the paper machine.

In prior art press sections, attempts have been made to solve the problem discussed above, e.g., by means of the press sections described in U.S. Pat. Nos. 4,359,827 and 4,359,828. In the press sections described in these patents, the web is not placed in direct contact with a face of a center roll in the press section, but a porous belt is fitted around the center roll. The belt corresponds to the length of the roll, i.e. to the working width of the machine, and while guided by guide rolls, supports the web on during the transfer run from the press section to the drying section. However, it is a substantial drawback of the solutions of these U.S. patents that the porous band utilized in these solutions loses some of its porosity in the nips in the press section, in which it is compressed to some extent. It is a second substantial drawback in these solutions that, at high temperatures, the band may lose most of its porosity, and in some extreme cases it may even melt.

As is known in prior art, attempts are made to employ high temperatures in the press section to intensify the dewatering. It is a further drawback in the solutions of said U.S. patents that the possibility of cleaning the porous belt is very poor. In the nips in the press section, the pores in the belt tend to be blocked, and the descriptions in said U.S. patents do not suggest any means for conditioning and cleaning of the band.

In Finnish Patent Application No. 885737 (filed Dec. 9, 1988), attempts have been made to provide a solution by whose means the drawbacks described above are avoided. In addition, the solution described in that patent application permits an increased running speed of a paper machine and ensures a problem-free transfer of the web from the press section to the drying section. In view of achieving the above, in said patent application, an endless metal band is passed over the center roll. The metal band is formed as a closed loop by means of guide and tensioning rolls and the closed loop is passed from the center roll to the beginning of the drying section. Thus, the web is transferred from the press section to the drying section while supported by this closed loop.

It is general aim among those skilled in the art to improve the dewatering capacity of presses in the press section of a paper machine. If the moisture content of a paper web can already be minimized in the press section, this amounts to considerable economies in the costs of paper manufacture, because the less wet the paper web is when it arrives from the press section, the lower the amount of energy consumed in the drying section. It can be considered a rule of thumb that, if the moisture content of the web in the press section can be made lower by one percentage unit, the consumption of energy in the drying section is about four per cent lower, which relates to considerable economies in cost. The dewatering capacity is generally improved by raising the pressing temperature of the paper web.

In the constructions commonly employed in prior art press sections, the center roll in the press constitutes an object of development. This is because of the material of the center roll which is commonly some suitable rock, for example granite. It is well known that rock rolls are quite sensitive to extensive and sudden changes in temperature, and the effects of such changes may be quite fatal to the smooth operation of the paper machine. Attempts have been made to develop suitable substitutes for granite rolls. However, it is difficult to make a suitable face for a center roll, and, moreover, the making of the face restricts the choice of the material for the rest of the roll.

In addition, different paper qualities require a different coating and frequently also a different process for the manufacture of the roll coating. Often, it is necessary to manufacture different paper qualities out of different raw materials by means of the same paper machine. A change in quality would also require change of center roll or at least of its coating. A center roll is, however, an expensive and heavy component, and its replacement requires a long and costly standstill of the paper machine.

If a center roll is provided, e.g., with a welded coating or if the coating is elastic, such as rubber-like, the device intended for heating of the paper web must necessarily be placed above the web if it is desirable to provide such a heating device in the construction before a third press nip in the press. However, before the third press nip in a press, there is hardly any space available for an efficient device that raises the temperature of the web and regulates the temperature profile. It is a drawback of a heater placed in this location that it causes contaminants to gather and fall down onto the paper web.

An attempt has been made partly to solve the problems discussed above by means of the method and the device described in Finnish Patent Application No. 891343 (filed Mar. 21, 1989). In the method described in FI 891343, it has been considered novel that a transfer band formed as an endless loop by means of tension and guide rolls, is passed over the center roll in the press section. The transfer band extends to outside the area of the press rolls and the paper web is transferred to run onto the transfer band. The paper web is heated in the area of the loop of the transfer band outside the press rolls.

The device in accordance with FI 891343 does not, however, solve the problems discussed above related to the detaching of the paper web from the face of the center roll and to its further transfer.

One particularly difficult problem, which was mentioned above preliminarily, arises from the fact that different paper qualities are often manufactured by means of the same paper machine, for example, depending on the market situation, the orders, or on the type of raw material that is available. The center rolls currently in operation and the belt solutions related to them do not permit a rapid and smooth change of paper quality produced by the press section. The change of quality should ideally take place quite rapidly, because any standstill time causes considerable economic losses. In the solutions presented in the prior art, adequate consideration has not been given to quick replacement of the belt running around the center roll or of the other press fabrics and press rolls in the prior art solutions.

Moreover, in prior art center-roll/transfer-belt arrangements, particular attention has not been paid to proper conditioning of the transfer belt running around the center roll or in other respects to safety and optimization of the transfer of the web taking place on the transfer belt.

OBJECTS AND SUMMARY OF THE INVENTION

Accordingly, it is an object of the present invention to provide a compact press section in a paper machine in which, at the same time, at least the most important ones of the problems discussed above are solved, together with some other problems.

It is another object of the present invention to provide a new and improved press section in which a suction roll is not needed to assist in detaching the web from a transfer band fabric so that the web can be transferred to the drying section.

It is yet another object of the present invention to provide a new and improved press section which keeps a smooth face of a center roll in the press section clean and free from debris. This object is important in particular when the paper machine produces fine papers.

It is still another object of the present invention to provide a new and improved press section which provides for improved control and regulation of the length in the machine direction of the press zone in the roll nips formed in connection with the center rolls. This object cannot be achieved at all by means of a metal band running around the center roll, such as in Finnish Pat. Application No. 885737.

In view of achieving the objects stated above and others, in the present invention, a transfer band running around the center roll is a transfer band fabric that substantially does not receive water and does not rewet the web. The web-adhesion properties of an outer face of the transfer band fabric have been chosen so that, after said last nip, the web follows the transfer band fabric, and so that the web can be transferred as a fully closed draw onto the drying wire or onto an equivalent fabric that carries the web further.

Further, in the present invention, in connection with the loop of the transfer band fabric, means for conditioning the band and/or safety devices are provided. The conditioning means provide and maintain an adequate operation of the transfer band fabric.

In a press section in accordance with the invention, as the transfer band, expressly a transfer band fabric is used that does substantially not receive water, so that the web is not rewetted when it is transferred on the outer face of the transfer band fabric between the nips and from the last nip onto the drying wire or equivalent. The transfer band fabric is preferably made as a multi-layer structure so that the choice of the material for its outer face provides suitable properties of adhesion to the web so that the web can be made to follow the transfer band fabric after the last press nip. On the other hand, the material is selected so that the web can be detached from the band in the transfer zone without problems and transferred onto the drying wire, e.g., as a suction-roll transfer. The structure and the materials of the transfer band fabric are chosen while also taking into account the properties of cleaning, conditioning, the mechanical strength properties, and the elastic properties of the band.

By means of the selection of the thickness and the elasticity of the transfer band fabric, it is also possible to control the length in the machine direction of the nip zones in the roll nips formed in connection with the center rolls and, thereby, the process of pressing in the roll nips.

It is an important feature of the present invention that a relatively inexpensive transfer band fabric also operates as the wearing replacement part which protects the expensive and heavy center roll. In the invention, the center roll can be manufactured irrespective of its coating, with consideration to the mechanical aspects alone. The transfer-band fabric loop can be arranged as quickly replaceable, e.g., in connection with any desired change of paper quality being produced in the paper machine. Thus, for each paper quality to be manufactured, it is possible to design and to store exactly the particular sort of transfer band loop that is best suitable for the quality concerned in view of its properties of adhesion, dewatering, etc.

The invention is also related to a frame construction of a press section, which is preferably arranged so that the center roll is mounted on an intermediate frame part or on the front or rear frame. The front or rear frame is cantilevered in respect of this part and provided with detachable intermediate pieces placed in the side frames at the operating side, The center roll is mounted preferably by means of fixed bearing supports. The transfer-band fabric loop is thus quickly replaceable after opening the intermediate pieces.

Moreover, in the press section, quick replacement of the press rolls and the other fabrics can be arranged favorably by lifting the press rolls straight upwards, e.g., by means of a crane mounted on the ceiling, without difficult operations of shifting to the side, This is achieved by making the frame part open at the top and/or partly openable at the top by shifting the press rolls from above the center roll to the side by means of intermediate frame parts.

In the invention, it is preferable to provide the transfer fabric loop with a cleaning and safety arrangement, by whose means it is possible to prevent the web from running around the transfer belt loop as a result of an unsuccessful web transfer. This undesirable running would form a web layer that destroys the fabrics on the face of the transfer belt loop.

In the invention, the transfer belt fabric may be impermeable or permeable to some extent. When a permeable transfer belt fabric is used, it is preferable to use a hollow-faced center roll whereas in connection with an impermeable belt, it is preferable to use a smooth-faced center roll, such as a roll with a cast-iron body.

In other embodiments of the present invention, a drying cylinder is arranged inside a loop of the transfer band fabric. the web and transfer band fabric runs over the cylinder where the drying wire is brought into contact. Thereafter, the web is separated from the transfer band fabric and continues to run on the drying wire into the drying section. In this manner, it is not necessary to provide a suction roll to assist in the detachment of the web from the transfer fabric. A conditioning nip for the transfer fabric is formed after the web is detached from the transfer fabric. This nip may be formed between two additional guide rolls, or alternatively, between the drying cylinder arranged inside the loop of the transfer fabric and an additional counter roll.

In another embodiment, a drying cylinder is arranged so that the web and transfer fabric pass over a sector of the drying cylinder before the web is detached from the transfer fabric. The drying wire is also brought into contact with the web over the roll so that when the web detaches from the transfer fabric, it will follow the drying wire into the drying section.

BRIEF DESCRIPTION OF THE DRAWINGS

In the following, the invention will be described in detail with reference to some exemplifying embodiments of the invention shown in the figures in the accompanying drawing, the invention being in no way strictly confined to the details of said embodiments.

FIG. 3A shows a hollow-faced roll as the center roll of the press,

FIG. 3B shows a variation in which the pick-up felt operates as the press felt in all of the three subsequent press nips in the press section, FIGS. 3C, 3D and 3F show different variations of the accomplishment of the closed draw of the web by means of a transfer fabric in accordance with the invention and a suction-transfer roll onto the drying wire of the drying section, FIG. 3G shows different safety and conditioning arrangements for the transfer fabric loop in accordance with the invention, and FIG. 3H shows arrangements of cleaning and heating of the transfer fabric loop in accordance with the invention.

DETAILED DESCRIPTION OF THE INVENTION

Figure 1:
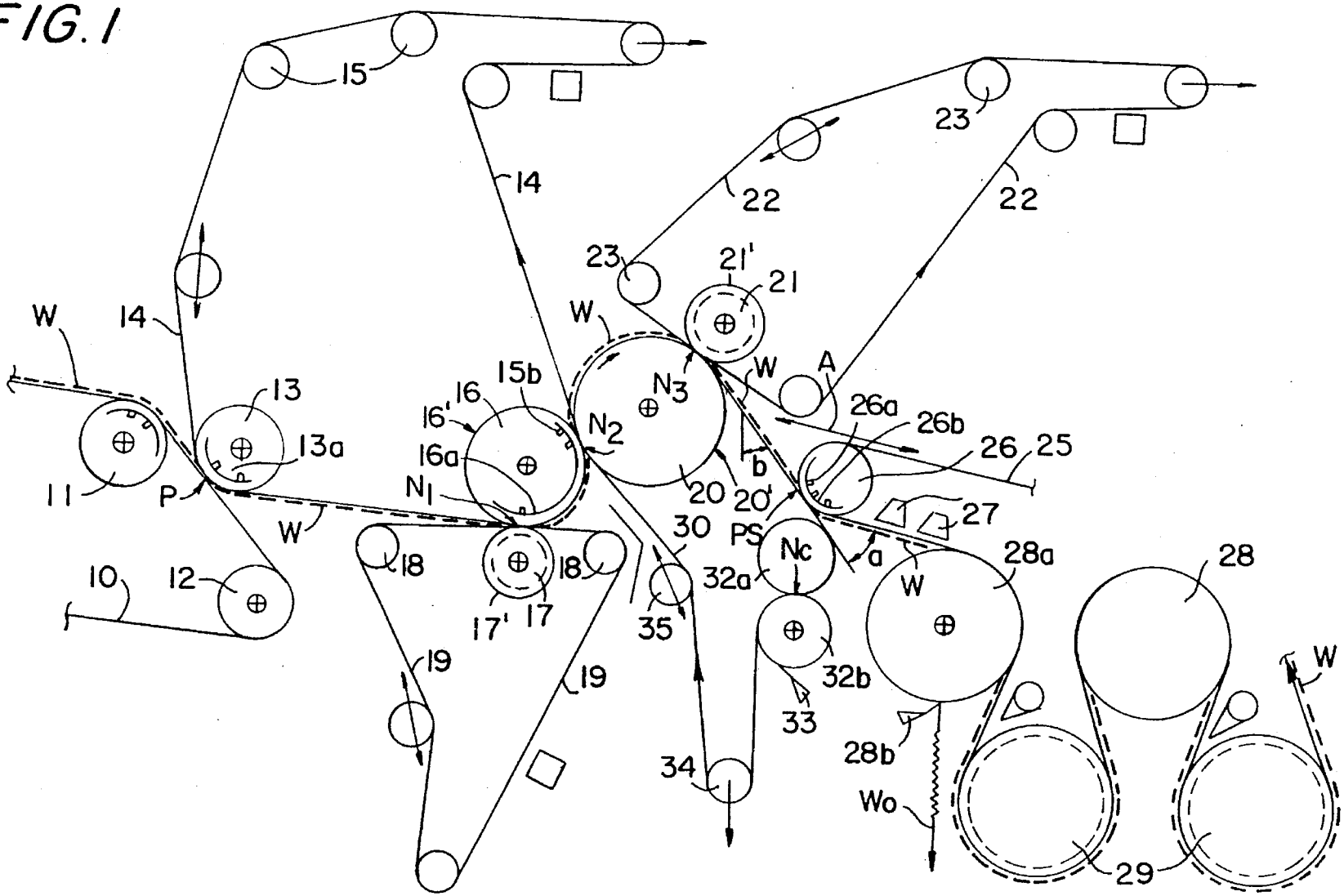
FIG. 1 is a schematic side view of a preferred embodiment of a press in accordance with the invention.

FIG. 1 is a schematic side view of a preferred press section in accordance with the invention, whose basic construction is the assignee's Sym-Press-II™ press section. A paper web W is drained on a forming wire 10. The web W is transferred at a pick-up point P on the forming wire 10 between a suction roll 11 and a drive roll 12 onto a pick-up fabric 14 with the aid of the negative pressure in suction zone 13*a* of a pick-up roll 13.

The web W is transferred on the lower face of the pick-up felt 14 into a first dewatering press nip $N_1$. This nip $N_1$ is a two-felt nip formed between a lower, hollow-faced 17' press roll 17 and an upper suction roll 16. A lower felt 19 runs through nip $N_1$ which is arranged to remove water from the web which is guided by guide rolls 18. After the nip $N_1$, with the aid of the negative pressure effective through perforations 16' in suction zone 16*a* of the suction roll 16, the web W follows the pick-up felt 14 and is transferred on its face into a second press nip $N_2$. The pick-up felt 14 acts as a press fabric in nip $N_2$ and receives water.

In the area of the second nip $N_2$, the suction roll 16 has a second suction zone 16*b*, after which after which the web W follows a face of the transfer belt fabric 30. The transfer fabric 30 is arranged in accordance with the invention and runs around a center roll 20 in the press. Fabric 30 has such properties of adhesion to the web so that the web is detached from the face of the pick-up felt 14 after the nip $N_2$ and follows the face of the transfer belt fabric 30. The web is then transferred on the face of the transfer fabric 30 into a third press nip $N_3$. In the transverse direction, the transfer belt fabric 30 extends substantially over the entire length of the center roll 20 and slightly beyond the web W width.

The nip $N_3$ is formed between the center roll 20 and a hollow-faced 21' press roll 21. A press felt 22, guided by guide rolls 23, runs through the nip $N_3$. After the nip $N_3$, the web W follows the outer face of the transfer belt fabric 30, which face is more adhesive to the web W than the face of the press felt 22. On the downwards inclined straight run of the fabric 30, the web W is transferred without substantial rewetting and as a fully closed and constantly supported draw, onto the drying wire 25 in the drying section. This transfer is a substantially nonrewetting transfer.

The transfer belt fabric 30 and a transfer suction roll 26 form a transfer zone PS, in whose area the web W is transferred onto the drying wire 25. This transfer is aided by a first suction zone 26*a* of the transfer suction roll 26, in which zone the negative pressure is higher than in the subsequent second suction zone 26*b*. The different negative pressures in the suction zones ensures that the web W remains on the face of the drying wire 25. The web W is kept on the straight run of a drying wire 25 after the transfer suction roll 26 on the lower face of the drying wire 25 with the aid of the field of negative pressure produced by suction boxes 27. The web is then transferred onto a first heated drying cylinder 28*a*. From the drying cylinder 28*a*, the web W follows the drying wire 25 over suction cylinders 29 and continues further as a single-wire draw through the first drying group in the drying section.

After the transfer zone PS, the transfer belt fabric runs through a safety and conditioning nip $N_c$ formed by rolls 32*a* and 32*b*. Of these rolls, the lower one 32*b* is provided with a drive gear, and on its lower face there is a doctor 33 which keeps a face of the roll 32*b* clean. The operation of the nip $N_c$ will be discussed in more detail later in connection with the description related to FIG. 3G. After the roll 32*b*, the run of the transfer belt fabric 30 continues to a tensioning roll 34 which turns the run of the transfer belt loop upwards to guide roll 35. From guide roll 35, the transfer belt fabric 30 runs further as a straight run into the second nip $N_2$.

Figure 2:
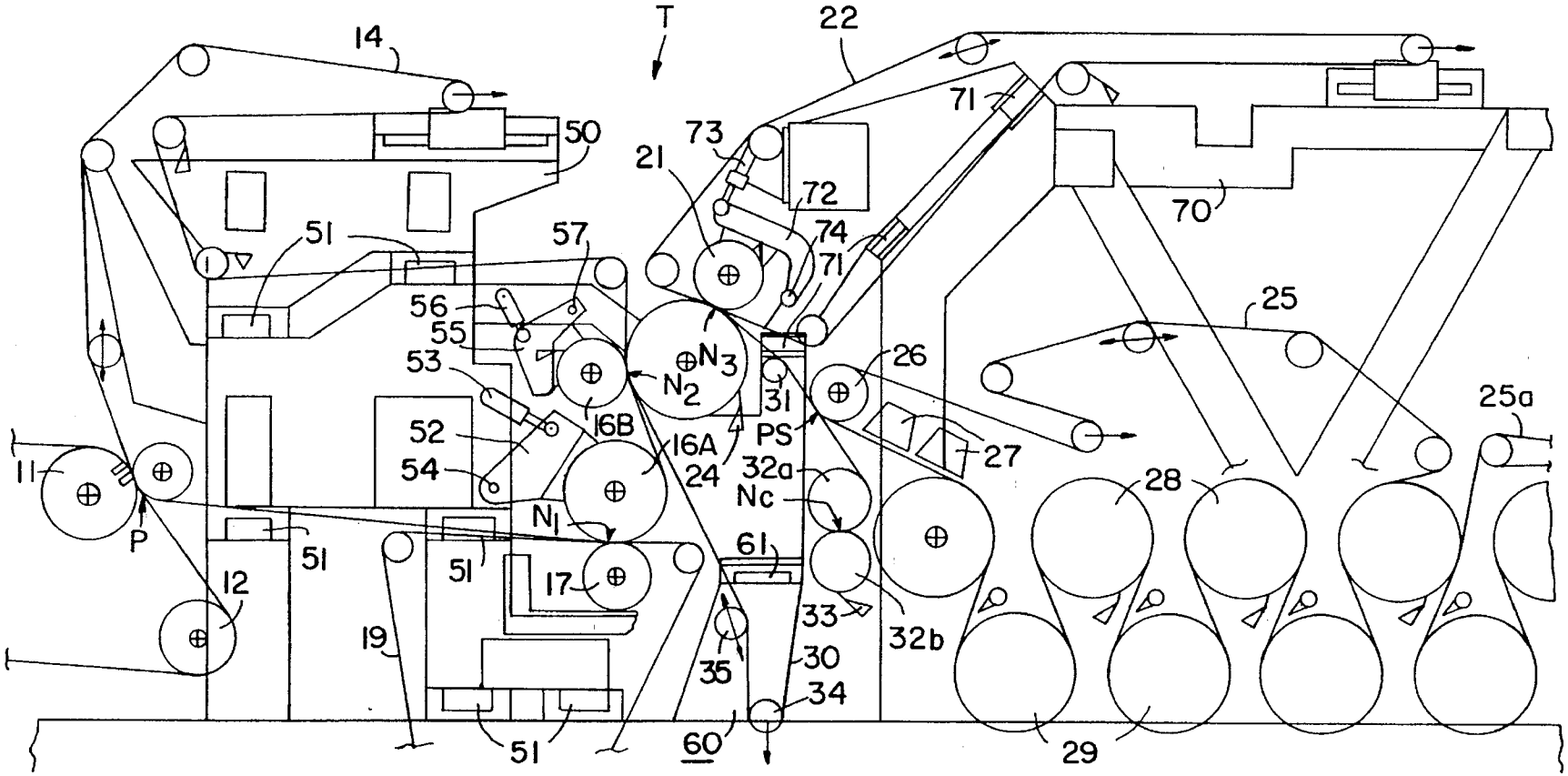
FIG. 2 shows a second version of the invention. Further, in FIG. 2, the frame constructions of the press section, which are related to the present invention, are also shown schematically.

FIG. 2 illustrates an application of the invention to the applicant's Sym-Press-O™ press section. FIG. 2 also shows the frame constructions of the press section, because they are in certain respects related to the inventive idea of the present invention. In the following, those features of construction of a press section as shown in FIG. 2 which are different from that described above in respect of FIG. 1 will be discussed.

According to FIG. 2, the first nip $N_1$ is formed between a lower roll 17 and an upper press-suction roll 16A. The press roll 16A does not form a press nip with the center roll 20. Rather, the web W is transferred from the suction zone of the roll 16A on the pick-up fabric 16 as an upwards directed straight run into the second nip $N_2$, which is formed between the center roll 20 and a hollow-faced press roll 16B.

Differing from FIG. 1, after the third nip $N_3$, the run of the transfer belt fabric 30 is guided by a guide roll 31. After guide roll 31, the web W is transferred on the transfer zone PS, where the web W is transferred onto the drying wire 25.

According to FIG. 2, a cleaning doctor is arranged on the lower sector of the center roll 20 that is free from the fabric loop 30. A press section as shown in FIG. 2 is advantageous especially when it is necessary to regulate the nip loads within wide limits, because in all the nips $N_1$, $N_2$ and $N_3$, it is possible to employ variable-crown rolls 17;16*b* and 21.

In the following, the press frame construction shown in FIG. 2 will be described in the respects in which it is related to the present invention. The press section comprises a front frame 50 and a rear frame 70, between which there is a space T. Space T is open at the top or, alternatively, is arranged so that it can be opened quickly. Through space T, the press rolls in the compact combination of rolls, as well as the upper fabrics 15 and 22, can be replaced quickly without disassembly of the frame parts.

Press roll 16B, which forms the second nip $N_2$, is mounted on loading arms 55 which are attached to the front frame 50 by means of horizontal articulated joints 57. Press roll 16B is pivoted by means of a power unit 56 for the purpose of loading and opening of the second nip $N_2$ so that a space is opened above the lower press roll 16A and the center roll 20 for their replacement. This replacement takes place upwards through the open or openable space T by means of a crane mounted on the ceiling.

In a corresponding manner, the press roll 21 is mounted on loading levers 72 which are attached by means of horizontal articulated joints 74 to the front part of the rear frame 70. Press roll 21 is pivoted by means of a power unit 73 for the purpose of loading the nip $N_3$ as well as for shifting the roll 21 aside for replacement of the press rolls placed underneath. This replacement is also carried out through the space T by lifting substantially straight upwards by means of the crane mounted on the ceiling.

The center roll 20 is mounted by means of fixed bearing supports on an intermediate frame 60 which is attached to the rear frame 70 by means of intermediate pieces 71. In accordance with the present invention, the top portion of the intermediate frame 60 is cantilevered and provided with intermediate pieces 61 and 71 for quick replacement of the transfer-belt fabric loop 30. This occurs, for example, when the paper quality manufactured by means of the paper machine is changed and when the transfer belt fabric 30 is also replaced to comply with the new quality or when a worn transfer belt fabric 30 or fabrics is/are replaced. The intermediate frame 60 may also be a part of the front or rear frame 50;70.

Both the front frame 50 and the rear frame 70 are also cantilevered in a way in itself known and provided with openable intermediate pieces 51,71 placed at the operating side of their side frames for the purpose of replacement of the upper fabrics 15 and 22.

For replacement of the lower fabric 19 of the first nip $N_1$, the lower part of the front frame 50 is also provided with openable intermediate pieces 51.

FIG. 2 also shows a part of the frame construction of the drying section as well as an initial portion of a second drying wire 25A provided with single-wire draw.

The transfer-band fabric loop 30 extends across the entire width of the web W in the transverse direction. The adhesiveness of the outer face of the transfer band fabric 30 to the web W is chosen so that, after the last nip $N_3$, the web W follows the transfer band fabric 30 without rewetting, and also so that the detaching in the transfer zone PS can be accomplished without disturbances. The transfer band fabric 30 preferably has a multi-layer structure, for example such that it includes a net-like or fibrous fabric, into which an outer-surface layer of suitable adhesiveness and the other layers have been impregnated by means of suitable plastic materials.

With respect to the dimensions and properties of the transfer band fabric 30, the thickness of the transfer band fabric 30 is, e.g., in the range of from about 1.5 mm to about 8 mm. The hardness of the outer face of the transfer band fabric 30 is, e.g., in the range of from about 1 P&J to about 100 P&J. The thickness and the resilience of the transfer band fabric 30 are chosen so that the length in the machine direction of the nip zones in the nips $N_2$ and $N_3$ through which the transfer band fabric 30 runs is in the range from about 25 mm to about 70 mm when the linear load in the nips $N_2$ and $N_3$ is in the range from about 10 kN/m to about 200 kN/m.

The transfer band fabric 30 is preferably made as a joint-free closed loop, in which case it must be replaced by opening the intermediate piece 61 and 71, and the frame part 60,70 must be cantilevered. The transfer band fabric 30 may also be made so that it has a joint, in which case the intermediate pieces in the intermediate frame 60 and the cantilevering are unnecessary.

The run of the transfer band fabric 30 from the last nip $N_3$ is preferably such that the straight run of the transfer band fabric 30 or the run guided by the guide roll 31 is at an angle b downwards in relation to the vertical plane. Angle b is preferably selected within the range of from about 10° to about 50°. In order that the transfer onto the drying wire 25 or an equivalent transfer fabric in the transfer zone PS should be free of problems even at high speeds, the angle a of change in the direction of the web W in the transfer zone PS is arranged as little as possible. Generally, the angle a is less than 60°. Most appropriately, the angle a is chosen in the range of from about 2° to about 50°.

In a press section in accordance with the invention, the threading of the web W takes place preferably so that the web W is first passed as of full width down from the first drying cylinder 28*a*. The web W to be passed to broke in connection with the threading is detached from the lower face of cylinder 28*a* by means of a doctor 28*b*, and then transferred into a pulper (not shown) in the direction of the arrow $W_0$. Hereupon, in the area of the wire part of the press section 28, from a web W of full width, a narrow leader is cut, which is threaded in a way in itself known through the drying section, whereupon the web W is widened to full width. The web can be passed in full width while being aided by suction transfer rolls 29.

In the following, with reference to FIGS. 3A to 3H, different variations will be described for various component fields of the invention.

Figure 3A:
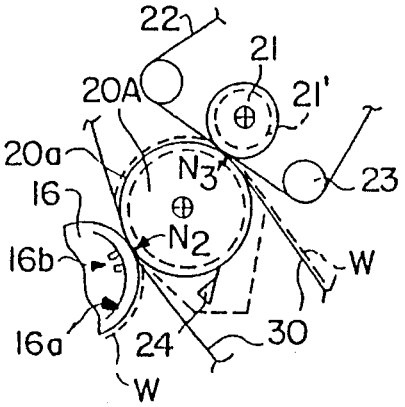
FIGS. 3A to 3H show different variations for various details of the press sections as shown in FIGS. 1 and 2 as follows.

According to FIG. 3A, the center roll 20A is a hollow-faced 20*a* roll, around which a transfer belt fabric 30 runs which is arranged in accordance with the invention. In this embodiment, the transfer belt fabric 30 is to some extent permeable to water, and it is in contact with the water-receiving hollow face 20*a* of the center roll 20A. On the sector of the center roll 20A that is free from the belt 30', there is a trough 36 for gathering of water and contaminations. The roll face 20*a* is kept clean by a cleaning doctor 24.

Figure 3B:
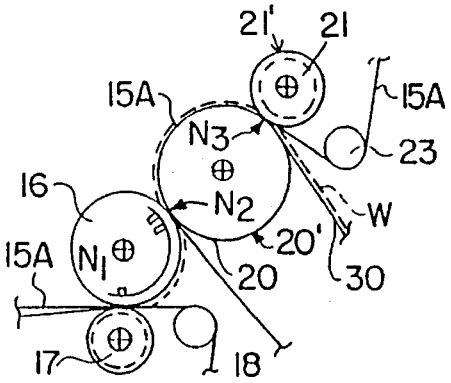
Figure 3C:
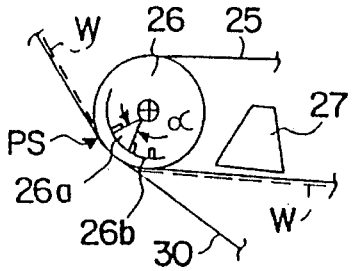

According to FIG. 3B, the pick-up felt 15A runs through all of the three subsequent press nips $N_1$, $N_2$ and $N_3$ and operates in them as a press fabric that received water. This construction provides the advantage that, between the nips $N_2$ and $N_3$, the pick-up felt 15A presses the web W against the outer face of the belt 30. In this manner, separation of the web W from the face of the belt 30 between the nips $N_2$ and $N_3$ is prevented even with a very little adhesion. The arrangement shown in FIG. 3B can also be applied in a press of the Sym-Press-O™ type shown in FIG. 2.

In this embodiment, a closed loop of the pick-up felt 15A is passed around the center roll 20 whereby the web is carried between the outer face of the pick-up felt 15A and the outer face of the transfer band 30 through the press nip $N_2$. Then, the web is carried around the center roll to the press nip $N_3$. The web is detached from the pick-up felt after press nip $N_3$.

FIGS. 3C, 3D, 3E and 3F show some alternative solutions, by whose means it is ensured that the web W can be detached reliably from the outer face of the transfer belt fabric 30 and transferred onto the drying wire 25. According to FIG. 3C, the transfer suction roll 26 has a transfer zone PS between the wire 25 and the fabric 30 on the suction zone 26*a* of the suction roll 26. The magnitude $\alpha$ of the zone 26*a* is preferably arranged adjustable in the range of $\alpha$=about 0° to about 45°, preferably in the range of $\alpha$=from about 5° to about 20°. By means of regulation of the angle $\alpha$, it is partly possible to optimize the transfer of the web. In the first zone 26*a* in the suction roll, there is a negative pressure, which is generally at the level of from about 0.1 bar to about 0.7 bar. In the next zone 26*b*, there is a lower negative pressure that ensures the transfer, said negative pressure being generally in the range of from about 0.05 bar to about 0.4 bar.

Figure 3D:
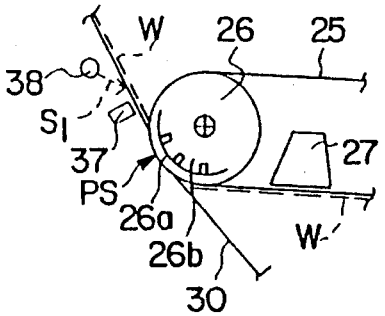

According to FIG. 3D, before the transfer zone, a bending shoe 37 is placed against the inner face of the transfer belt fabric, which shoe 37 is preceded by water jet means 38. The area between the inner face of the transfer fabric 30 and the curved guide face of the bending shoe 37 is lubricated by means of water jets $S_1$ applied from said water jet means 38. Owing to the guide face of the shoe 37, detaching forces, which arise from a slight difference in velocity, are produced between the outer face of the transfer fabric 30 and the web W.

In connection with, or instead of, the shoe 37, it is possible to employ ultrasonic oscillators, by means of whose energy impulses the contact between the web W and the outer face of the belt 30 is shaken to make it more favorable for the transfer onto the drying wire 25.

Figure 3E:
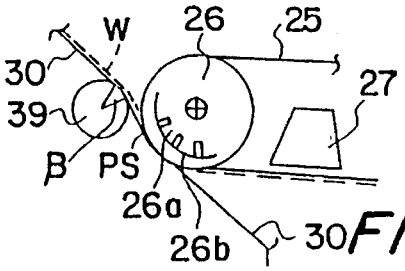

According to FIG. 3E, the bending shoe 37 as shown in FIG. 3D is substituted for by a corresponding revolving guide roll 39, by means of whose sector $\beta$ an effect is produced that corresponds to that produced by the bending shoe 37.

Figure 3F:
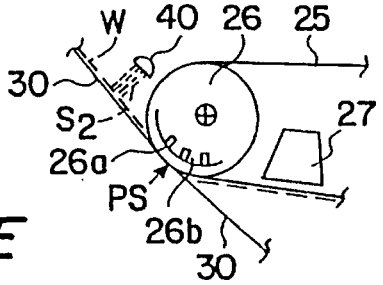

According to FIG. 3F, before the transfer zone PS of the transfer suction roll 26, at the proximity of the web W, an infrared heater 40 is arranged. By means of radiation $S_2$ produced by the heater 40, the temperature of the water present in the web W is raised in particular, whereby the separation of the web from the outer face of the transfer belt fabric 30 is promoted.

Figure 3G:
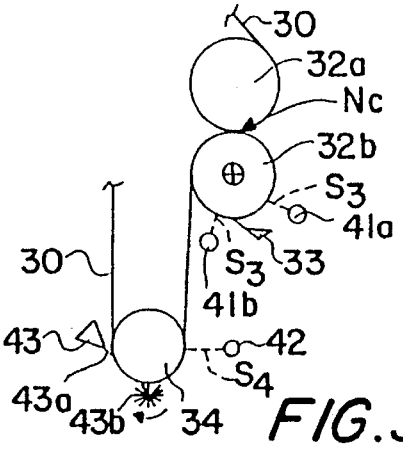

FIG. 3G shows a safety and/or cleaning nip $N_c$ operating on the loop of the transfer belt fabric 30 and formed between the rolls 32*a* and 32*b*. The lower roll 32*b* is provided with a drive gear, and the properties of its surface are chosen so that, should the web W follow the face of the transfer belt fabric 30, it adheres to the roll face 32*b*, from which it is detached by means of the doctor 33 and transferred into the pulpar placed underneath. The cleaning roll 32*b* has a considerable sector of contact with the transfer fabric 30. The bending of the transfer band fabric in opposite directions with relatively short curve radii, taking place on the rolls 32*a* and 32*b*, promotes the cleaning quality of the transfer band fabric 30 considerably. Moreover, the face of the roll 32*b* is chosen such that impurities adhere to this face, from which they are detached and washed by means of water jets and/or chemical jets $S_3$ applied from the jet pipes 31*a* and 31*b*. The lower roll 32*b* is preferably a roll provided with a smooth face that makes the web adhere to the roll, for example a rubber-faced, a Dynarock™-faced or a Mikrorock™-faced roll. The nip load in the nip $N_c$ is preferably in the range of from about 5 to about 30 kN/m. The safety function of the nip $N_c$ is of particular importance with certain pulp raw-materials which are even highly contaminating.

Figure 3H:
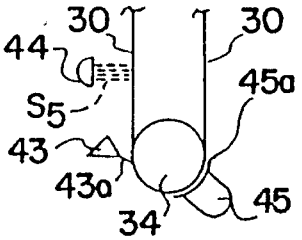

According to FIG. 3H, the transfer band fabric 30 is heated at the level of the tensioning roll 34 by means of steam jets applied from the steam box 45 into the treatment gap 45*a*. Moreover, according to FIG. 3H, the fabric 30 is heated by means of radiation $S_5$ applied from an infrared radiator 44. In this way, the temperature level of the fabric loop 30 is raised, the cleaning is intensified, and thermal energy is transferred by the intermediate of the fabric 30 to act in the press nips $N_2$ and $N_3$ to promote the dewatering of the web W by means of mechanisms known per se.

In respect of the detail of the structure and properties of the transfer band fabric 30 in accordance with the invention, reference is made to the applicant's FI Patent Applications Nos. FI 823187, corresponding to U.S. Pat. No. 4,526,655, and FI 842114, corresponding to U.S. Pat. No. 4,976,821, in which various belt-like transfer fabrics are described, which can be applied as a transfer band fabric 30 in the present invention, at least after certain modifications.

If necessary, the press sections in accordance with FIGS. 1 and 2 may also be employed as conventional press sections with open draw when the running speed of the paper machine and/or the strength of the paper web do not require a closed draw. The conversion to conventional press sections is carried out by removing the transfer belt 30 and by shifting either the transfer suction roll 26 alone (arrow A) or the transfer suction roll 26 and the suction boxes 27 to the optimal distance (e.g., 20–120 mm) from the center roll 20 that is required by an open draw of the paper web W. Such a shifting can be carried out, e.g., by means of hydraulic or pneumatic cylinders.

Figure 4:
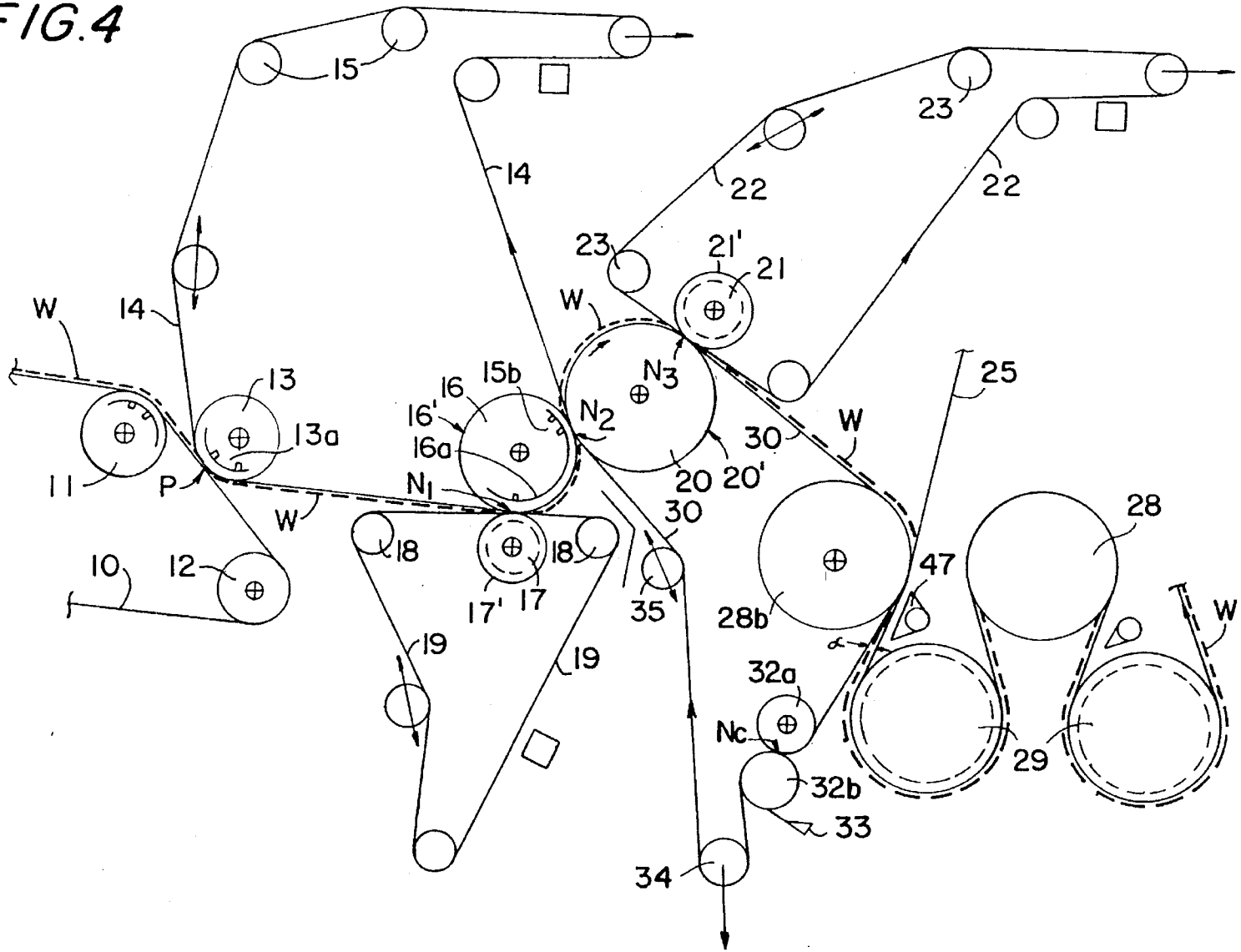
FIG. 4 shows another embodiment of a press section in accordance with the present invention.

FIG. 4 shows a press section in which the web W is carried as a closed draw by means of a transfer belt 30 to a drying section in connection with a compact press section. The press section comprises three nips $N_1$, $N_2$, and $N_3$ in which the web W is pressed in nips $N_2$ and $N_3$ against the transfer belt 30 passed around the center roll 20. The web W is transferred on the surface of the transfer belt 30 after the last press nip $N_3$ around a roll or cylinder **28*b* arranged inside the transfer belt loop. The drying wire 25 wraps a small portion of the cylinder 28*b* such that the web W adheres to the surface of the drying wire 25 at a substantially small angle. By means of a suction blow box 47 and a suction guide roll 29, a negative pressure is produced on the transfer belt 30 and the drying wire 25 so that they separate from one another while the web is carried with the drying wire 25**.

In the embodiment of FIG. 4, the first drying cylinder **28*b* is substituted for the suction roll 26. The press section is otherwise similar to that illustrated in FIG. 1. Drying cylinder 28*b* assists in the detaching of the web from the transfer band fabric 30. The transfer band felt 30 is passed around the first drying cylinder 28*b*, or an equivalent guide roll, so that the web is transferred to the surface of the drying wire 25 almost immediately after the web contacts the drying cylinder 28*b*. The web W may be carried by the transfer band felt 30 over a short sector of the cylinder until the web is detached. Drying cylinder 28*b* is arranged inside the loop of the transfer band fabric 30 and before the conditioning nip $N_c$. There is a substantially straight run of the web W on the transfer band fabric 30 between the drying cylinder 28*b* and the center roll 20**.

In a preferred embodiment, the transfer is helped by selecting a detachment angle $\alpha$ which is preferably in the range of about 0° to about 30°. Angle $\alpha$ is defined as the angle between the transfer belt 30 and the drying wire 25 measured in proximity to the area of detachment of the web from the transfer belt 30, i.e. after the transfer belt 30 has passed over the drying cylinder **28*b*. Pressure box 47 may be oriented to direct the negative pressure at the same angle as angle $\alpha$ or parallel to the drying wire 25**.

In the embodiment illustrated in FIG. 4, the press section also comprises means for conditioning the transfer band felt 30 similar to the press section shown in FIGS. 1 and 2. These conditioning means maintain an adequate operation of the transfer band fabric 30 prevent the transfer of the web W on the surface of the transfer band fabric 30 back to press nips $N_2$ and $N_3$.

The conditioning means comprise a conditioning nip $N_c$ defined between a first roll **32*a* and a second roll 32*b* both of which are arranged along a vertical axis and after the transfer zone and in connection with the loop of the transfer band fabric 30. The transfer band fabric 30 contacts an upper area of the first roll 32*a* and is guided around the first roll 32*a* and through the conditioning nip $N_c$. The transfer band 30 thereafter continues in a downward path around the second roll 32*b*. Doctor means 33 are arranged on a sector of the second roll 32*b* which is free from the transfer band fabric 30. The doctor means 33 remove debris from a roll face of the second roll 32*b***.

Drying cylinder **28*b* is preferably a heated smooth-faced drying cylinder of a standard diameter. Alternatively, drying cylinder 28*b* may be a smaller diameter drying cylinder, i.e. a so-called baby cylinder, a leading cylinder or other suitable press roll. After separating from the transfer fabric 30 in the area of the drying cylinder 28*b*, the web W is passed further into the drying section and around drying cylinders 29**.

Figure 5:
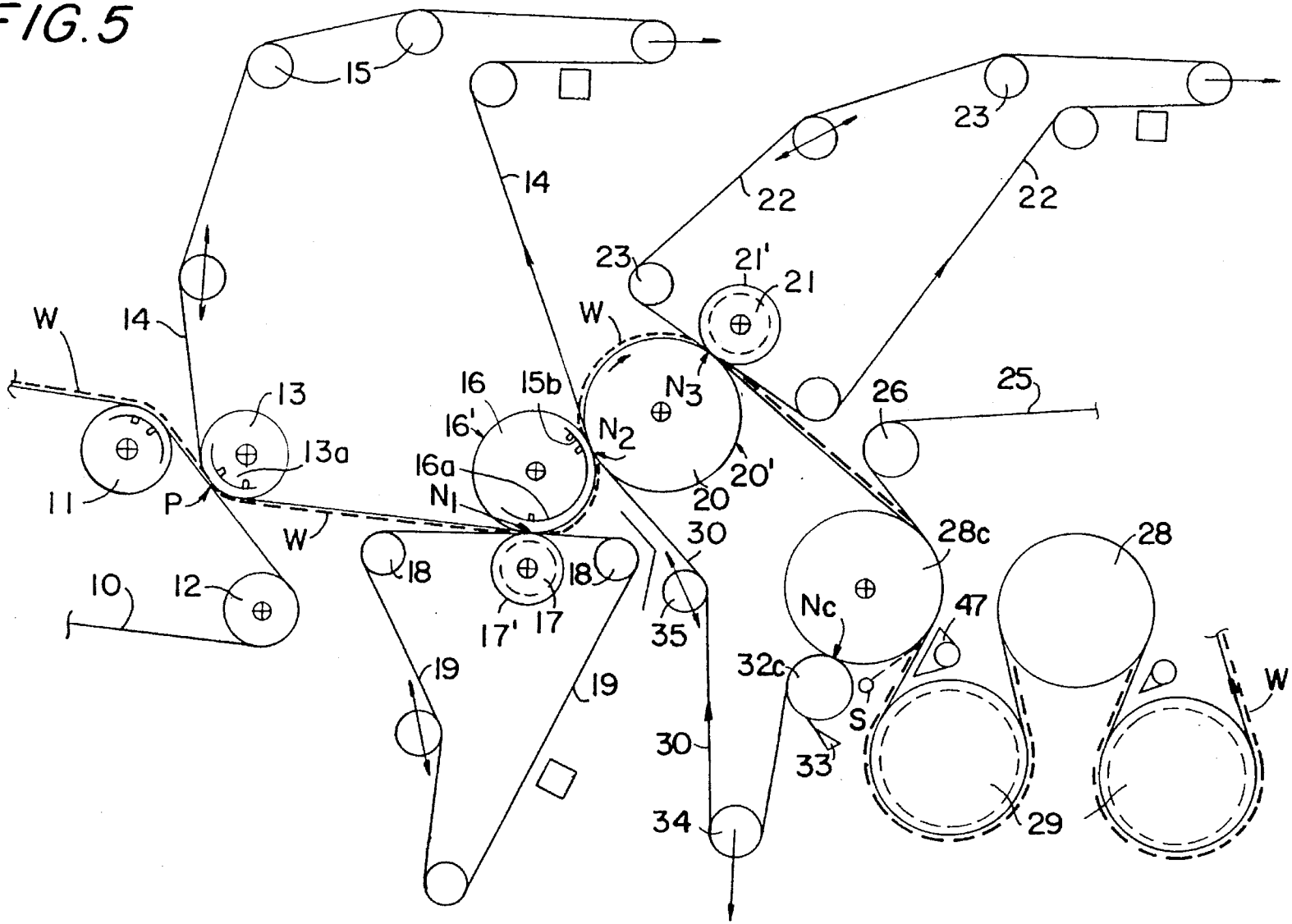
FIG. 5 shows yet another embodiment of a press section in accordance with the present invention in which a drying cylinder is arranged inside a loop of a transfer band fabric.

Referring now to FIG. 5, a press section similar to FIG. 4 is illustrated. In this embodiment, the conditioning nip $N_c$ is formed between a counter roll **32*c* and the drying cylinder 28*b* or equivalent roll. Moreover, the transfer belt 30 travels through a larger angle with the drying wire 25, i.e. over a larger sector of the drying cylinder 28*b*. This may be achieved by means of a guide roll 26 arranged between the drying cylinder 28*b* and center roll 20 so that a small angle is formed between the drying wire 25 and the web W being carried on the transfer band fabric 30. The drying wire runs over guide roll 26 so that the angle of contact between the drying wire and the web, and thus the sector of the cylinder 28*c*** over which the drying wire runs, can be regulated.

In this embodiment, only one additional roll (roll **32*c*) is needed to form the conditioning nip $N_c$ as the drying cylinder 28*b* serves as one of the rolls of the nip. Doctor means 33 operate on the counter roll 32*c*. A jet S comprises an air and/or steam jet which aids in the detachment of the web from the face of the transfer belt 30 and in the transfer of the web to the drying wire 25**.

Figure 6:
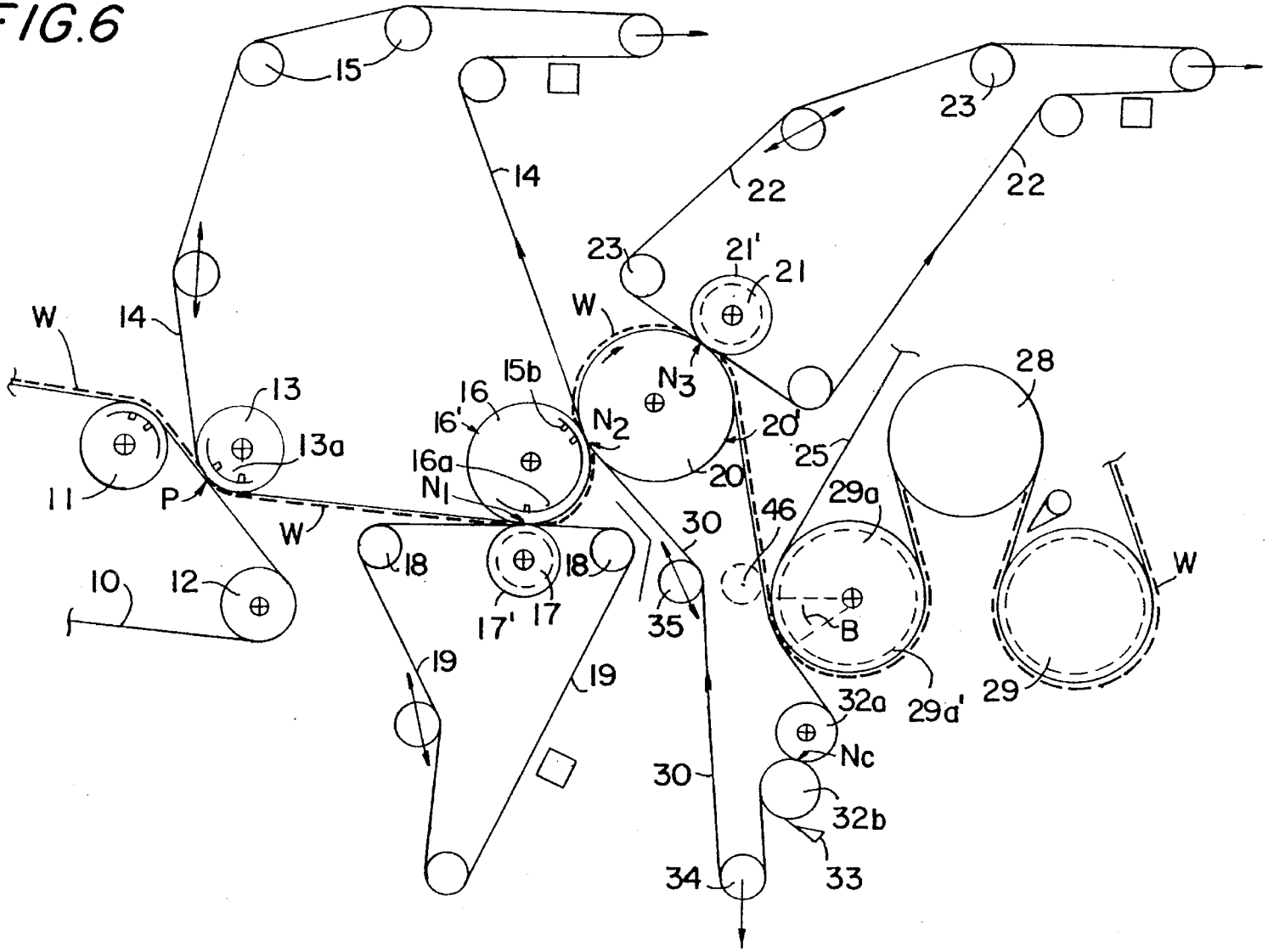
FIG. 6 shows another embodiment of a press section in accordance with the present invention.

In the press section shown in FIG. 6, the transfer belt 30 is passed along a face of a first lower roll or suction guide roll **29*a* after the press nips $N_2$ and $N_3$. The transfer belt 30 is passed through a contact sector on the suction roll 29*a* having an angle of about 0° to about 45° so that the web W adheres to an outer surface of the drying wire 25. The suction guide roll 29*a* is not arranged inside the loop of the transfer band, rather, it is arranged in the drying section inside a run of the drying wire. The loop of the transfer belt 30** is provided with a safety or conditioning nip $N_c$.

In addition, in this embodiment, a roll 46 or corresponding deflecting means, e.g., deflecting shoe, is arranged inside the transfer belt loop 30 and before the transfer belt 30 is brought into contact with the drying wire 25 in sector $\beta$.

The first lower roll **29*a* of the drying section, as well as the other lower rolls or cylinders in the drying section, are preferably leading suction cylinders marketed by the assignee under the trademark VAC™ roll. This type of cylinder 29*a* has a grooved outer mantle 29*a'* on which the grooves open into perforations formed in the roll mantle. The interior of the roll mantle is connected to a source of negative pressure (not shown) without a suction zone. The VAC™ roll is described in detail in U.S. Pat. No. 5,022,163, the specification of which is incorporated herein. Thus, the first lower roll 29*a* provides a suctioning operation of the web W, transfer belt 30 and/or drying wire 25** without the need for a separate suction zone to be formed in the roll.

Figure 6A:
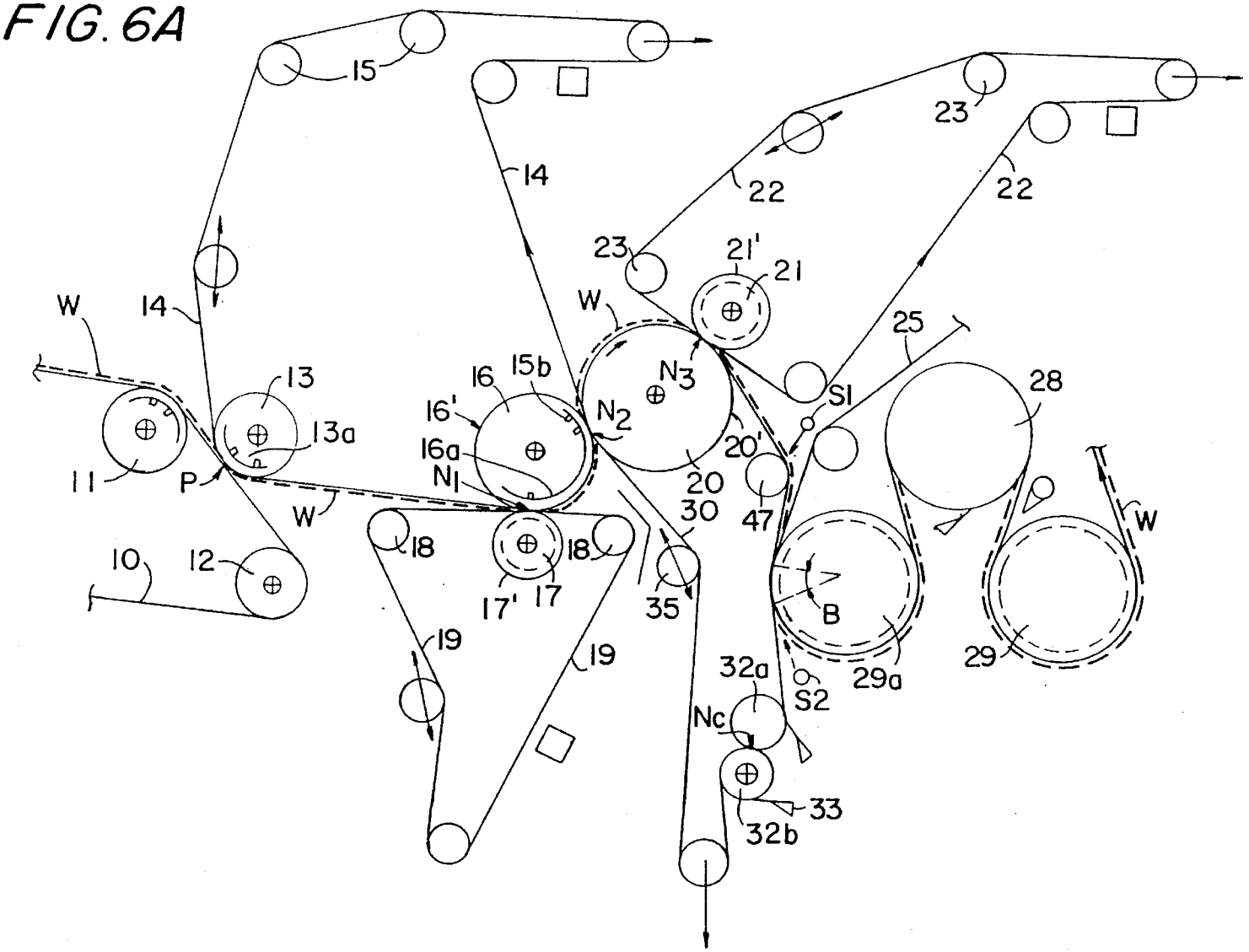
FIG. 6A shows yet another embodiment of a press section in accordance with the invention.

The press section illustrated in FIG. 6A is similar in some respects to the press section illustrated in FIG. 6. However, the press section in FIG. 6A provides for a small adjustable angle X between the transfer belt 30 and the drying wire 25 before cylinder 29A. Cylinder 29A may be a transfer suction roll. The formation of angle X aids in the transfer of the web W from the transfer belt 30 to the drying wire 25.

In a preferred embodiment, in order to regulate and adjust angle X, a guide roll 47 is arranged inside the loop of the transfer belt 30 between the center roll 20 and the cylinder 29A. Guide roll 47 may be replaced by other suitable deflecting means which would deflect the transfer belt 30.

The adhesion of the web W to the transfer belt 30 is further reduced during the threading operation by an air or steam jet $S_1$. The air or steam jet $S_1$ operates against the guide roll 47. In a preferred embodiment, jet $S_1$ may also be arranged to introduce condenser water onto the surface of the web W in order to improve the adhesion of the web W to the face of the drying wire 25. Moreover, the transfer of the web after the contact point is helped by another air or steam Jet $S_2$ which operates in proximity to the area of separation of the transfer belt 30 from the web W. The press section of FIG. 6A may also be provided with a conditioning and safety nip $N_c$ comprising a smooth roll 33. Jet $S_2$ is preferably arranged to introduce condenser water onto the face of the transfer belt 30 in order to improve adhesion of any piece of the web W, or any fibers which are not passed onto the drying wire, to the face of the smooth roll 33 of the conditioning nip $N_c$.

Figure 7:
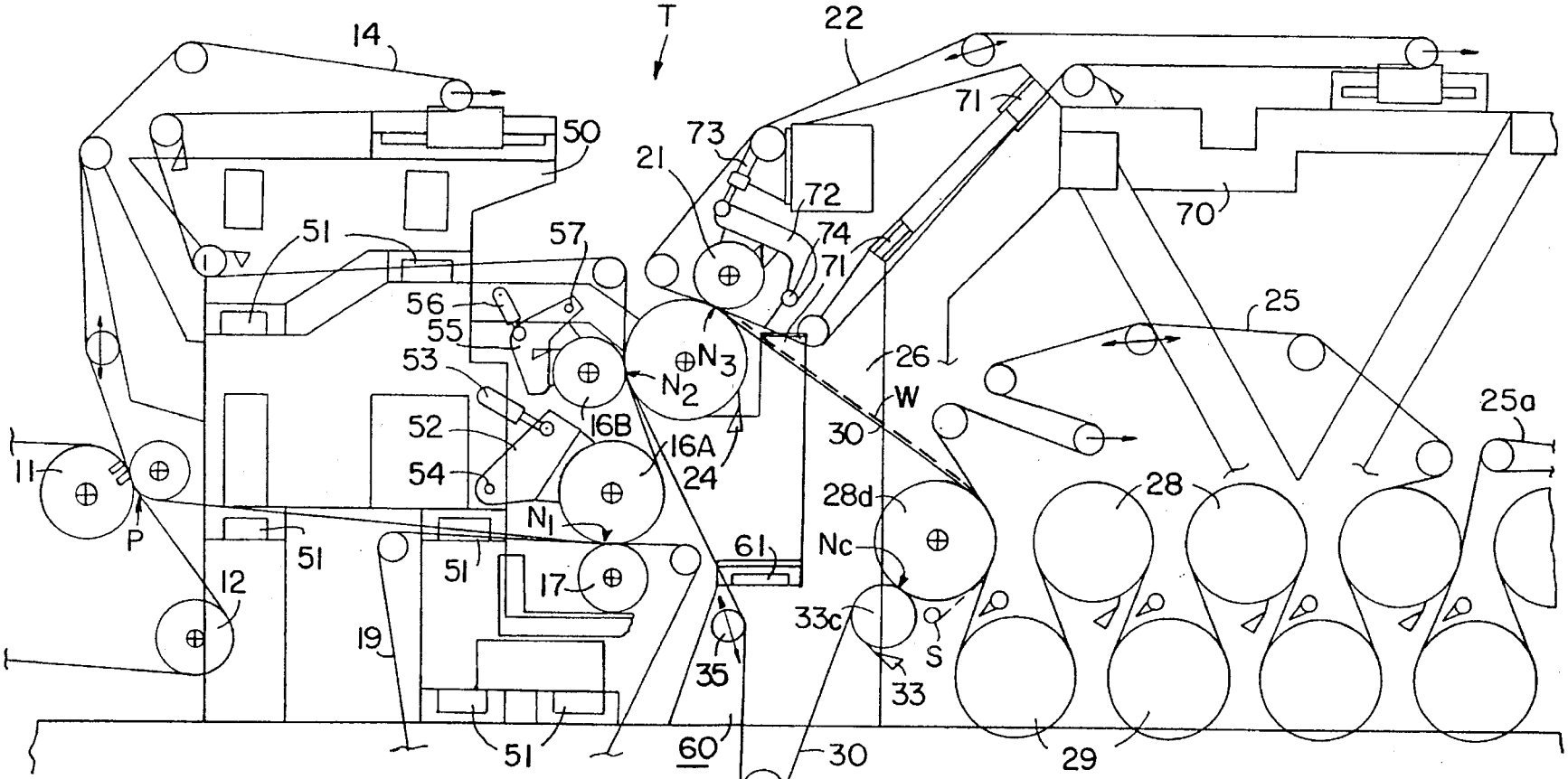
FIG. 7 shows a frame construction around a press section as illustrated in FIG. 5.

Referring to FIG. 7, a frame construction including a press section as shown in FIG. 5 is illustrated. It is also possible to use the press sections illustrated in FIGS. 2, 4 and 6 in the frame construction of FIG. 7. The particular frame construction shown in FIG. 7 is similar is most regards to the frame construction of FIG. 2 and is marketed by the assignee under the trademark "Sym-Press O"™.

Roll 28*d* is arranged inside a loop of the transfer belt 30 and may be an ordinary drying cylinder similar to the other drying cylinders used in the drying section. Alternatively, roll 28*d* may be a heated drying cylinder of a smaller diameter, e.g. a baby cylinder, or a guide roll which is not provided with any such heating.

In the present invention, if a heated drying cylinder (28*b* of FIG. 4, 28*c* of FIG. 5, or 28*d* of FIG. 7) is indeed arranged inside the transfer belt 30, an additional advantage is obtained in that the heated cylinder heats the transfer belt 30 and raises its temperature. Therefore, the transfer belt 30 will transmit thermal energy to the nips $N_2$ and $N_3$ thereby intensifying the dewatering in these nips at least to some extent by lowering the viscosity of the water drained from the web and by changing the elastic properties of the web.

Further, in the frame construction, an air or steam jet device S facilitates the detachment of the web W from the transfer belt 30. These jet devices S are most advantageously used in the threading operation. As the drying cylinder 28*d* is preferably provided with perforations as discussed above, the compact press section in the frame construction shown in FIG. 7 does not require the use of suction rolls provided with internal suction boxes as described in relation to FIGS. 1–3. These suction rolls are noisy and consume a relatively high amount of suction energy. Moreover, none of the embodiments of the present invention illustrated in FIGS. 4–7 require a suction roll, which does not perform any other function, to detach the web as a drying cylinder is substituted for such a suction roll.

In the following, the patent claims will be given, and the various details of the invention may show variation within the scope of the inventive idea defined in said claims and differ from the details described above by way of example alone.

What is claimed is:

1. A closed press section in a paper machine, comprising a compact combination of press rolls defining press nips with each other, one of said press rolls being a center roll, a plurality of fabrics supporting a web, one of said fabrics comprising a transfer band defining a closed loop around said center roll, said transfer band having an outer face upon which the web is transferred, at least a last one of said press nips being defined between said center roll and another one of said press rolls, a closed loop of said transfer band being passed around said center roll, said transfer band defining a closed draw located after said last press nip in said compact combination of rolls, the web being constantly supported in said closed draw, said transfer band comprising a fabric which substantially does not receive water such that said transfer band does not rewet the web, said outer face of said transfer band fabric having web-adhesion properties such that, after said last nip, the web follows said transfer band fabric in a straight run, a drying cylinder arranged inside said loop of said transfer band and after said straight run in the running direction of the web such that said transfer band carries the web over a sector of said drying cylinder, and directing means for directing a drying wire over said sector of said drying cylinder into engagement with the web carried on said transfer band, a loop of said drying wire being devoid of any roll directly opposite said drying cylinder, said directing means and said drying cylinder being arranged relative to one another such that the web is detached from said transfer band fabric in said sector and directly transferred onto said drying wire that carries the web further into a drying section following said press section.

2. The press section of claim 1, further comprising an intermediate frame, said center roll being mounted on said intermediate frame by means of fixed bearing supports, said intermediate frame being cantilevered and provided with detachable intermediate pieces for quick replacement of said transfer band loop.

3. The press section of claim 1, wherein said directing means comprise a guide roll arranged inside a loop of said drying wire, said drying wire running over said guide roll before contacting the web in said sector of said drying cylinder, the position of said guide roll causing the length of said sector on said drying cylinder to be regulated.

4. The press section of claim 1, further comprising means for conditioning said transfer band fabric, said means structured and arranged to maintain an adequate operation of said transfer band fabric.

5. The press section of claim 4, wherein said means for conditioning said transfer band fabric comprise a conditioning nip defined between first and second rolls located after said transfer zone and in connection with said transfer band loop, said first roll in the direction of running of said transfer band fabric being located inside said transfer band loop, and said second roll being located outside said transfer band loop, and jet and/or doctor means located on a sector of said second roll, said jet and/or doctor means being structured and arranged such that a face of said second roll is kept clean and any web which may run over said face of said second roll to broke, is separated from said face of said second roll.

6. The press section of claim 5, wherein said transfer band fabric contacts said first roll and is guided around said first roll and through said conditioning nip, said transfer band thereafter continuing in a downward path around said second roll.

7. The press section of claim 1, further comprising separating means for separating said transfer band fabric from said drying wire after said drying cylinder such that an angle is formed between said transfer band fabric and said drying wire, said angle being in the range of about 0° to about 30°.

8. The press section of claim 7, wherein said separating means comprise a suction guide roll arranged after said drying cylinder in the running direction of said transfer band fabric in said loop of said drying wire.

9. The press section of claim 1, further comprising a suction blow box arranged between said drying cylinder and a second cylinder in said drying section of said press section, said blow box producing a negative pressure such that the web adheres to said drying wire.

10. The press section of claim 9, wherein said second cylinder is a suction guide roll arranged to produce a negative pressure such that the web adheres to said drying wire.

11. The press section of claim 1, further comprising means for conditioning said transfer band fabric, said means comprising a counter roll arranged to define a nip with said drying cylinder after the web is detached from said transfer band fabric, and jet and/or doctor means located on a sector of said counter roll, said jet and/or doctor means being structured and arranged such that a face of said counter roll is kept clean and any web which may run over said face of said counter roll to broke, is separated from said face of said counter roll.

12. The press section of claim 11, further comprising detaching means for detaching the web from said transfer band fabric, said detaching means comprising a suction blow box arranged between said drying cylinder and a second cylinder in said drying section of said press section, said blow box producing a negative pressure such that the web adheres to said drying wire, and an air and/or steam jet directing a jet stream in proximity to a point of separation of the web from said transfer band fabric, said jet stream aiding in the detachment of the web from said transfer band fabric and the transfer of the web to said drying wire.

13. The press section of claim 11, wherein another of said press rolls defines a second nip with said center roll, said another press roll being mounted on intermediate frame parts which are attached to a front frame part of said press section by means of horizontal articulated joints, and said press roll which defines said last press nip with said center roll being mounted on other intermediate frame parts which are attached to a rear frame part of said press section by means of horizontal articulated joints, said intermediate frame parts being openable by means of actuators so that a space between said front frame part and said rear frame part is open or quickly openable at a top of said press section, wherein press rolls in said compact combination of rolls placed in the area of said space can be replaced by lifting them substantially straight upwards by means of a crane mounted on a ceiling.

14. A closed press section in a paper machine, comprising a compact combination of press rolls defining press nips with each other, one of said press rolls being a center roll, a plurality of fabrics supporting a web, one of said fabrics comprising a transfer band defining a closed loop around said center roll, said transfer band having an outer face upon which the web is transferred, at least a last one of said press nips being defined between said center roll and another one of said press rolls, a closed loop of said transfer band being passed around said center roll, said transfer band defining a closed draw located after said last press nip in said compact combination of rolls, the web being constantly supported in said closed draw, said transfer band comprising a fabric which substantially does not receive water such that said transfer band does not rewet the web, said outer face of said transfer band fabric having web-adhesion properties such that, after said last nip, the web follows said transfer band fabric in a straight run, a cylinder arranged inside said loop of said transfer band and after said straight run in the running direction of the web, said cylinder being arranged so that the web is detached around said cylinder from said transfer band fabric and directly transferred onto a drying wire that carries the web further into a drying section following said press section, a loop of said drying wire being devoid of any roll directly opposite said cylinder.

conditioning means for conditioning said transfer band fabric, said conditioning means comprising a counter roll arranged to define a nip with said cylinder after the web is detached from said transfer band fabric, and jet and/or doctor means located on a sector of said counter roll, said jet and/or doctor means being structured and arranged such that a face of said counter roll is kept clean and any web which may run over said face of said counter roll to broke, is separated from said face of said counter roll.

15. The press section of claim 14, further comprising detaching means for detaching the web from said transfer band fabric, said detaching means comprising a suction blow box arranged between said cylinder and a second cylinder in said drying section of said press section, said blow box producing a negative pressure such that the web adheres to said drying wire, and an air and/or steam jet directing a jet stream in proximity to a point of separation of the web from said transfer band fabric, said jet stream aiding in the detachment of the web from said transfer band fabric and the transfer of the web to said drying wire.

16. The press section of claim 14, wherein another of said press rolls defines a second nip with said center roll, said another press roll being mounted on intermediate frame parts which are attached to a front frame part of said press section by means of horizontal articulated joints, and said press roll which defines said last press nip with said center roll being mounted on other intermediate frame parts which are attached to a rear frame part of said press section by means of horizontal articulated joints, said intermediate frame parts being openable by means of actuators so that a space between said front frame part and said rear frame part is open or quickly openable at a top of said press section, wherein press rolls in said compact combination of rolls placed in the area of said space can be replaced by lifting them substantially straight upwards by means of a crane mounted on a ceiling.

17. The press section of claim 14, wherein said cylinder is a drying cylinder.

* * * * *